US008590947B2

(12) United States Patent
Qi et al.

(10) Patent No.: US 8,590,947 B2
(45) Date of Patent: Nov. 26, 2013

(54) LOCK DEVICE FOR SLIDING DOOR

(75) Inventors: Chao Qi, Anhui (CN); Yinghui Lu, Anhui (CN); Zhongying Dou, Anhui (CN); Lihua Lu, Anhui (CN); Xinhua Gao, Anhui (CN)

(73) Assignee: Chery Automobile Co., Ltd., Anhui (CN)

( * ) Notice: Subject to any disclaimer, the term of this patent is extended or adjusted under 35 U.S.C. 154(b) by 371 days.

(21) Appl. No.: 13/001,740

(22) PCT Filed: Jun. 30, 2009

(86) PCT No.: PCT/CN2009/072526

§ 371 (c)(1),
(2), (4) Date: Dec. 28, 2010

(87) PCT Pub. No.: WO2010/000195

PCT Pub. Date: Jan. 7, 2010

(65) Prior Publication Data

US 2011/0101713 A1 May 5, 2011

(30) Foreign Application Priority Data

Jun. 30, 2008 (CN) ..... 2008 1 0022271

(51) Int. Cl.
*E05B 3/00* (2006.01)

(52) U.S. Cl.
USPC .. 292/336.3; 292/201; 292/216; 292/DIG. 23

(58) Field of Classification Search
USPC ..... 292/336.3, 201, 216, DIG. 23
See application file for complete search history.

(56) References Cited

U.S. PATENT DOCUMENTS

| | | | | |
|---|---|---|---|---|
| 6,338,224 | B1 | 1/2002 | Sembommatsu | |
| 7,540,541 | B2 * | 6/2009 | Yoneyama et al. | 292/216 |
| 2005/0099017 | A1 * | 5/2005 | Yoneyama et al. | 292/216 |
| 2005/0104383 | A1 * | 5/2005 | Ottino | 292/216 |
| 2006/0061133 | A1 * | 3/2006 | Sawajiri | 296/146.1 |

FOREIGN PATENT DOCUMENTS

| | | | |
|---|---|---|---|
| CN | 1690341 | A | 11/2005 |
| CN | 1877063 | | 12/2006 |
| CN | 1944923 | A | 4/2007 |
| CN | 1975084 | A | 6/2007 |
| CN | 1993527 | | 7/2007 |
| CN | 101319587 | | 12/2008 |
| EP | 1031684 | | 8/2000 |
| EP | 1724419 | | 11/2006 |
| JP | 2007186882 | A | 7/2007 |

OTHER PUBLICATIONS

International Search Report; PCT/CN2009/072526; Aug. 20, 2009.

* cited by examiner

*Primary Examiner* — Carlos Lugo
*Assistant Examiner* — Mark Williams
(74) *Attorney, Agent, or Firm* — Kilpatrick Townsend & Stockton LLP

(57) ABSTRACT

A locking device for a sliding door includes an outer handle (10) provided on outside surface of the sliding door, a cable (20), a door lock switching element on inside surface of the sliding door, an unlocking lever/string (30) and a lock (70). Wherein, the outer handle (10) is joined with the door lock switching element on inside surface of the sliding door via the cable (20). The door lock switching element is joined with the lock (70) via the unlocking lever/string (30).

6 Claims, 6 Drawing Sheets

LOCK DEVICE FOR SLIDING DOOR

This application claims the priority of Chinese patent Application No. 200810022271.1, filed with the Chinese Intellectual Property Office on Jun. 30, 2008, entitled "LOCK DEVICE FOR SLIDING DOOR", the overall disclosure of which is hereby incorporated herein by reference.

FIELD OF INVENTION

The present invention relates to the field of vehicle door lock, and in particular to a lock device for sliding door.

BACKGROUND OF THE INVENTION

Currently, on a sliding door of vehicle, the space for arranging door lock control mechanism and door handle that is left by sheet-metal structure of vehicle body is not abundant. Therefore, it is very hard to reach a satisfactory effect through existing conventional arrangement. As shown in FIG. 1, an outer handle 10 is connected to a control mechanism for sliding door via a switch 20A generally comprising two or more switching elements. Thus, the switch 20A has to occupy a very large space in vehicle door along the direction from the outer side of vehicle body to the inner side of vehicle body, thus making the arrangement of lock body more difficult, and at the same time increasing the complexity and cost of product.

SUMMARY OF THE INVENTION

The objective of the invention is to provide a lock device for sliding door, which is simple in structure and is easy to install.

In order to achieve the above objective, the following technical solution is adopted by the invention: a lock device for a sliding door comprises an outer handle fixed on an outside surface of the sliding door, the outer handle is connected to a door lock switching mechanism provided inside the sliding door via a cable, the door lock switching mechanism is connected to a lock body via an unlocking lever/string, and the outer handle opens the lock body through the cable, the door lock switching mechanism and the unlocking lever/string sequentially.

As can be known from the above technical solution, in the invention, the cable is provided between the outer handle and the door lock switching mechanism. Since the cable is a line shape component, it takes up a small space in vehicle door, thus considerably reducing the difficulty in arranging lock body. As can be known from above, the invention is simple in structure, easy to install and low in cost.

DESCRIPTION OF THE PREFERRED EMBODIMENTS

Figure 1:
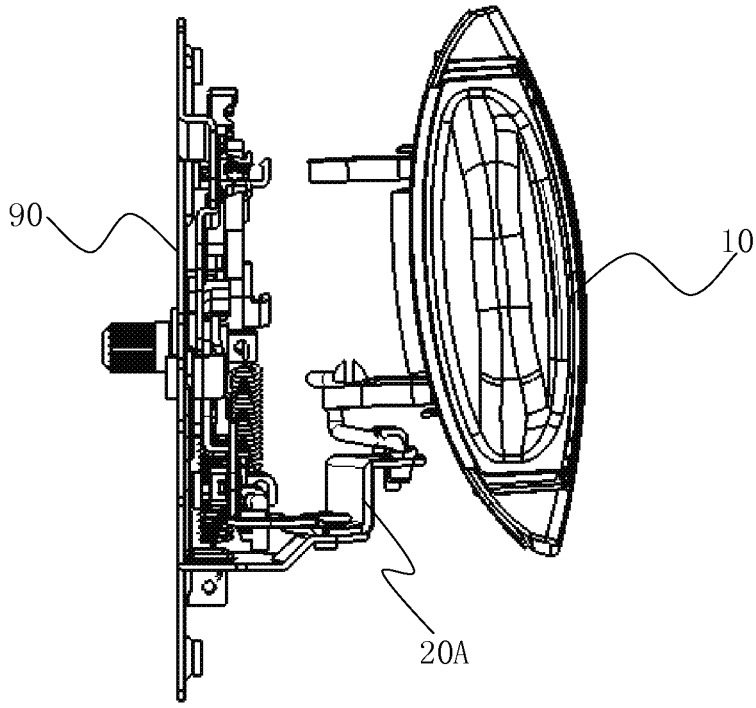
FIG. 1 is a schematic structural view of conventional lever type door lock.
Figure 2:
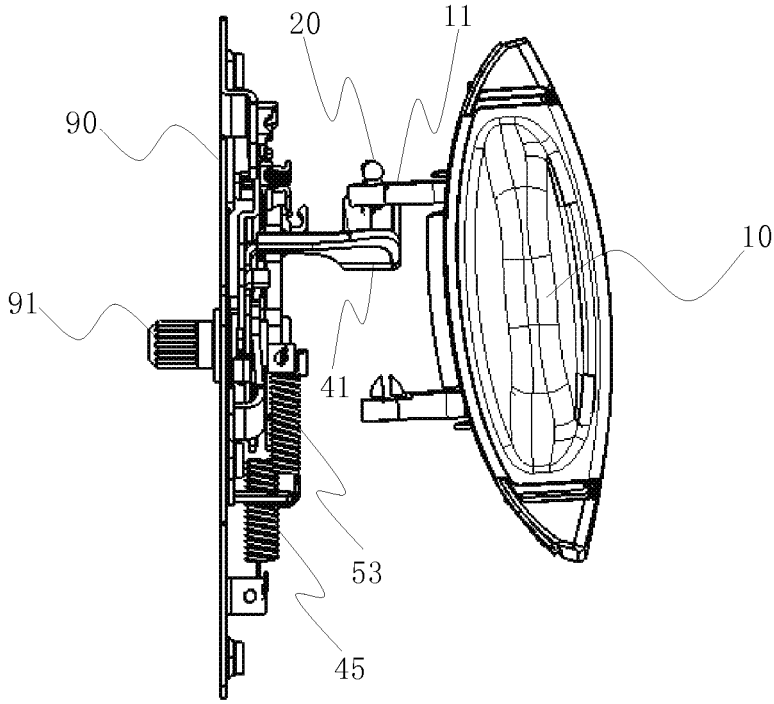
FIG. 2 is a front view of the door lock for sliding door according to the invention.
Figure 3:
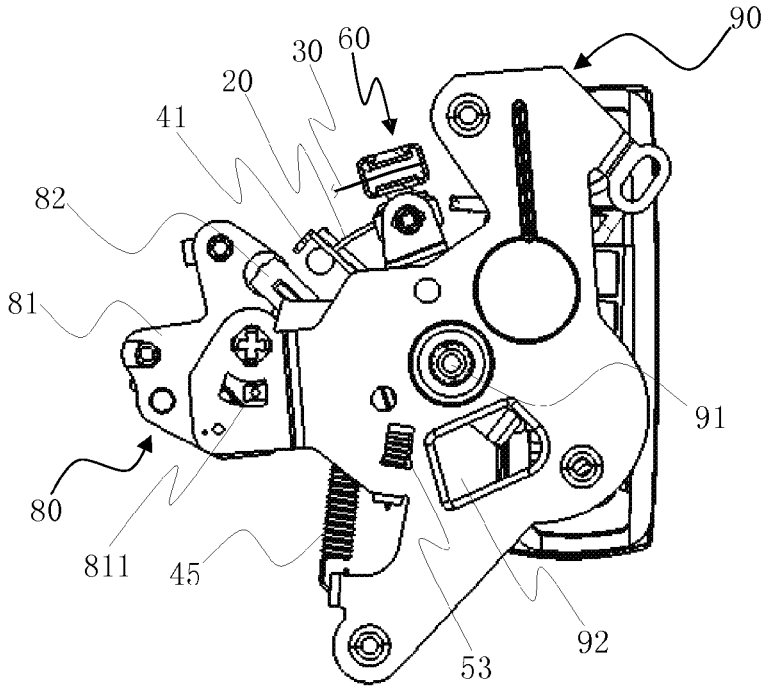
FIG. 3 is a left side view of FIG. 2.
Figure 4:
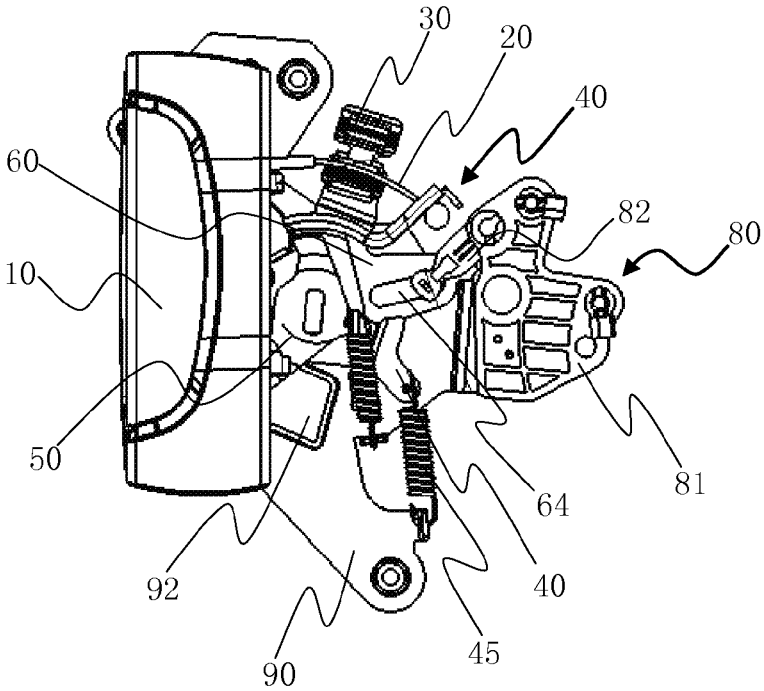
FIG. 4 is a right side view of FIG. 2.
Figure 5:
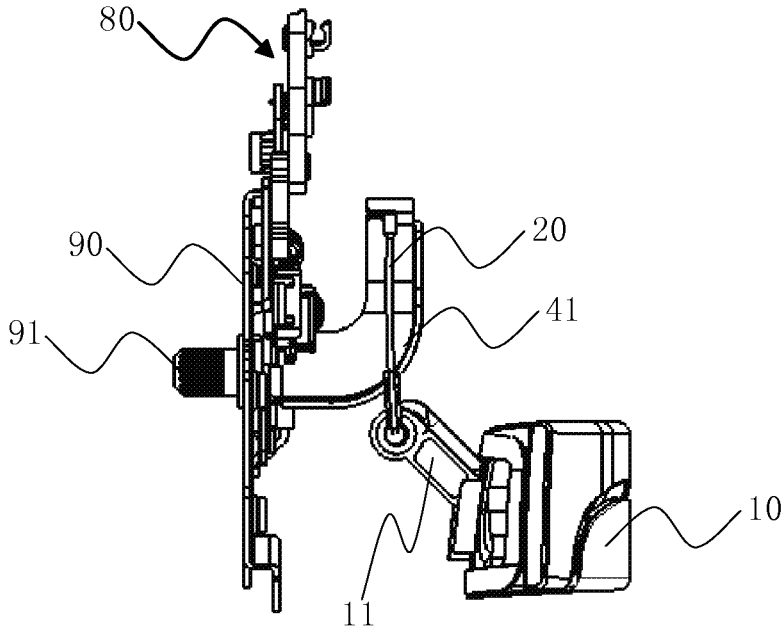
FIG. 5 is a top view of FIG. 2.
Figure 6:
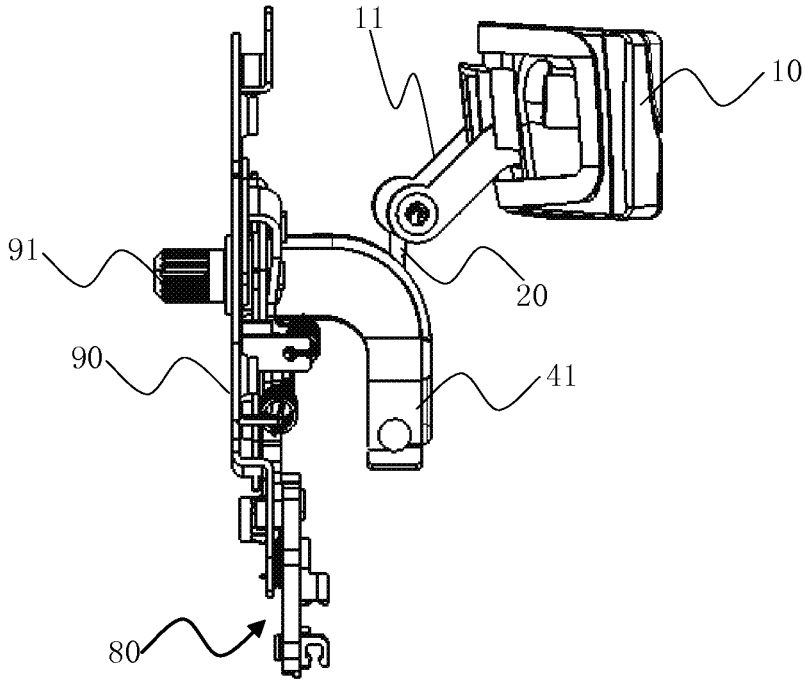
FIG. 6 is a bottom view of FIG. 2.
Figure 7:
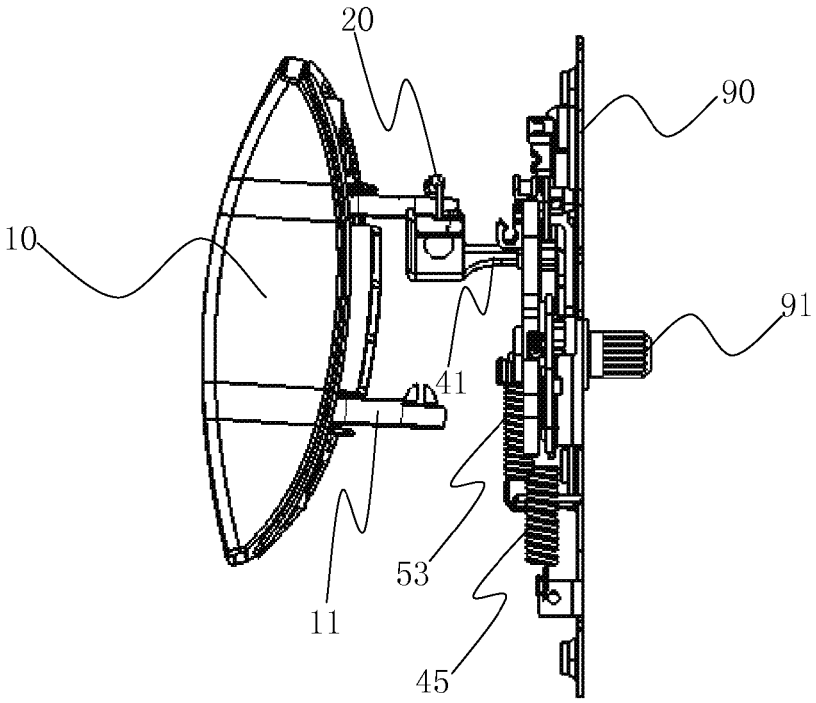
FIG. 7 is a rear view of FIG. 2.
Figure 12:
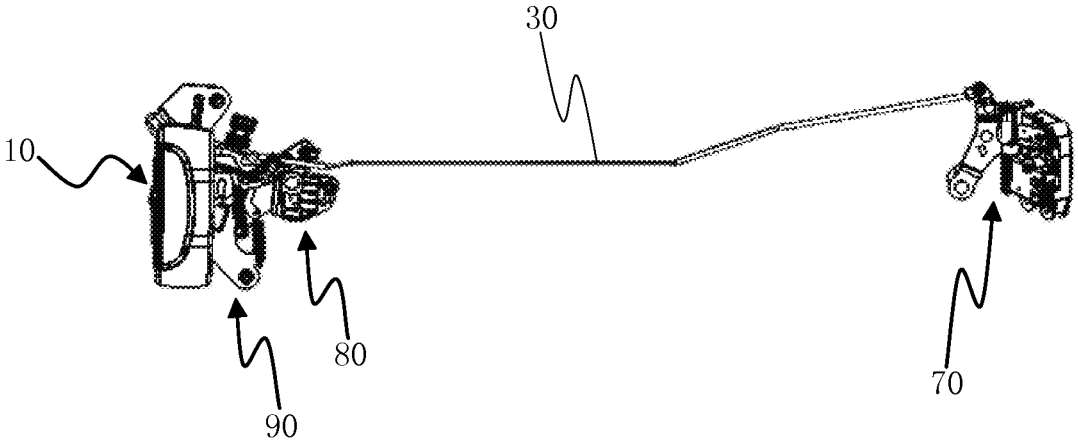
FIG. 12 is a schematic view showing the connection of the door lock of the invention with the lock body.

As shown in FIGS. 2 and 12, a lock device for a sliding door comprises an outer handle 10 fixed on an outside surface of the sliding door, the outer handle 10 is connected to a door lock switching mechanism provided inside the sliding door via a cable 20, the door lock switching mechanism is connected to a lock body 70 via an unlocking lever/string 30, and the outer handle 10 opens the lock body 70 through the cable 20, the door lock switching mechanism and the unlocking lever/string 30 sequentially.

As can be knows from above, the arrangement of the cable 20 enables that the outer handle 10 and the door lock switching mechanism can be more reasonably disposed in such a limited space as in the vehicle door in the invention, thus simplifying the structure and reducing cost.

As a preferred solution of the invention, as shown in FIG. 2, the side of the outer handle 10 inside the sliding door is provided with a cantilever 11 extending in the horizontal direction. One end of the cable 20 is fixed on the cantilever 11, and the other end is connected to a door lock switching mechanism provided on a bracket 90. The direction in which the cable 20 is subject to force is perpendicular to the fixed end thereof on the cantilever 11, and the bracket 90 is fixed inside the sliding door.

Since the cable 20 is employed to transmit force in invention, and the direction in which the cable 20 is subject to force is always perpendicular to the fixed end of the cable 20 on the cantilever 11, a waste of force for opening the sliding door is reduced so that the sliding door is easier to open.

As shown in FIGS. 2-7, the door lock switching mechanism comprises an outer switching element 40 and a lock body switching element 60 which rotate around a pin shaft 91 independently, wherein the pin shaft 91 is provided on the bracket 90. One end of the outer switching element 40 is provided with a first cantilever 41 on which a positioning groove is disposed, and the end of the cable 20 connected to the door lock switching mechanism is snap-fit in the positioning groove. One end of a restoring spring 45 is fixed on the bracket 90, and the other end is connected to the outer switching element 40 to restore it. The lock body switching element 60 is connected to the lock body 70 by means of the unlocking lever/string 30 disposed horizontally. The outer handle 10 opens the lock body 70 through the cable 20, the outer switching element 40, the lock body switching element 60 and the unlocking lever/string 30 sequentially.

The above arrangement realizes that an opening force is transmitted along the outer switching element 40 and the lock body switching element 60 in sequence, and finally opens the lock body 70 by means of the unlocking lever/string 30 on the lock body switching element 60, thus shorting an opening routine of force and reducing a loss.

As a further preferred solution of the invention, the pin shaft 91 is horizontally disposed and perpendicular to the length direction of vehicle, and the pulling force direction of the cable 20 is in a tangent line direction to rotation of the pin shaft 91.

The length direction of vehicle is namely the longitudinal direction from the front of vehicle to the rear of vehicle. The above arrangement of pin shaft 91 causes the opening direction of existing outer handle 10 to be perpendicular to the direction of force in the cable 20, so that user's effort is further reduced; while the fact that the pulling force direction of the cable 20 is in a tangent line direction to rotation of the pin shaft 91 ensures that the force required for the cable 20 to rotate the outer switching element 40 is less. The combination of two above-described manners provides a comfortable hand feel and a less opening force at the time of opening the sliding door with the outer handle 10.

As shown in FIGS. 4 and 8-11, the door lock switching mechanism further comprises an inner switching element 50 which is disposed coaxially with the outer switching element 40 and the lock body switching element 60 and is connected to an inner handle. One end of a restoring spring 53 is fixed on the bracket 90, and the other end is connected to the inner switching element 50 to restore it. The inner handle opens the lock body 70 through the inner switching element 50, the lock body switching element 60 and the unlocking lever/string 30 sequentially.

The above arrangement realizes that an opening force is transmitted along the inner switching element 50 and the lock body switching element 60 in sequence, and finally opens the lock body 70 by means of the unlocking lever/string 30 on the lock body switching element 60, thus also shorting an opening routine of internal opening force and reducing a loss.

As shown in FIGS. 2-11, the pin shaft 91 passes through the inner switching element 50, the outer switching element 40, the lock body switching element 60 and the body of the bracket 90 in sequence. The inner switching element 50 is provided with two cantilevers. A first cantilever 51 forms an abutting fit with a second cantilever 42 of the outer switching element 40, and enables the inner switching element 50 to drive the outer switching element 40 to rotate in the same direction. A second cantilever 52 of the inner switching element 50 forms a limiting fit with a limiting hole 92 on the bracket 90.

A third cantilever 43 of the outer switching element 40 forms an abutting fit with a second cantilever 62 of the lock body switching element 60 and enables the outer switching element 40 to drive the lock body switching element 60 to rotate and restore. A limit stop is provided on the bracket 90 for restoring a fourth cantilever 44 of the outer switching element 40 to original position after the rotation of the fourth cantilever 44. The fourth cantilever 44 of the outer switching element 40 is connected to the restoring spring 45.

A first cantilever 61 of the lock body switching element 60 is hinged to the unlocking lever/string 30, and a third cantilever 63 forms an abutting fit with the limit stop of the bracket 90 which limits the stroke of the third cantilever 63.

The limited stroke of the second cantilever 52 of the inner switching element 50 enables the moving stroke of the unlocking lever/string 30 to open the lock body 70.

As described above, the pre-described arrangement enables the inner switching element 50, the outer switching element 40 and the lock body switching element 60 to be integrated together. Not only can users open vehicle door from the outside of vehicle body conveniently, but also the vehicle door can be conveniently opened from the inside of vehicle body. Beside, during opening process, all of the transmitting routines of force are short, the whole door lock device is simple in structure and easy to realize.

Alongside the door lock switching mechanism is provided a lock-up mechanism 80 for switching the lock body switching element 60 between a locked state and a free state.

Due to the provision of the lock-up mechanism, vehicle door will not be opened accidentally, thus protecting people inside and outside of the vehicle from damage.

As a preferred solution of the invention, as shown in FIGS. 8-11, the lock-up mechanism 80 is composed of a crank 82 and a rocker arm 81 hinged to the bracket 90. One end of the crank 82 is hinged to the rocker arm 81, and the other end is a sliding block provided in a sliding groove 64 which is provided in the third cantilever 63 of the lock body switching element 60. Two end portions of the sliding groove 64 are located on the inner side and outer side of the rotating locus of the outer switching element 40 respectively. When moving to the inner side of the rotating locus of the outer switching element 40 along the sliding groove 64, the sliding block forms a top-abutment fit with the outer switching element 40. One end of the rocker arm 81 is provided with a stop 811 limited in an opening hole in the bracket 90. The limited stroke of the stop 811 enables the sliding block to slide from one end of the sliding groove 64 to the other end.

Since force has to be transmitted through the outer switching element 40, no matter the sliding door is opened from the inner side of vehicle body or from the outer side of vehicle body as described above, the invention arranges the sliding block on the end of the crank 82 to form a top-abutment fit with the outer switching element 40, thus limiting rotation of the outer switching element 40 and interrupting the transmission of force so that the sliding door lock is in the locked state.

As a further preferred solution of the invention, also as shown in FIGS. 8-11, a recess portion is provided between the sliding block and the body of the crank 82. The fourth cantilever 44 of the outer switching element 40 is in top-abutment with the recess portion, and enables the outer switching element 40 to drive the lock body switching element 60 in rotation to open the lock.

An opening hole 83 which is connected to the lever of an electrically actuated or manual deadlock mechanism is provided in the rocker arm 81.

The operation process of the invention will be described below in combination with FIGS. 8-11.

Figure 8:
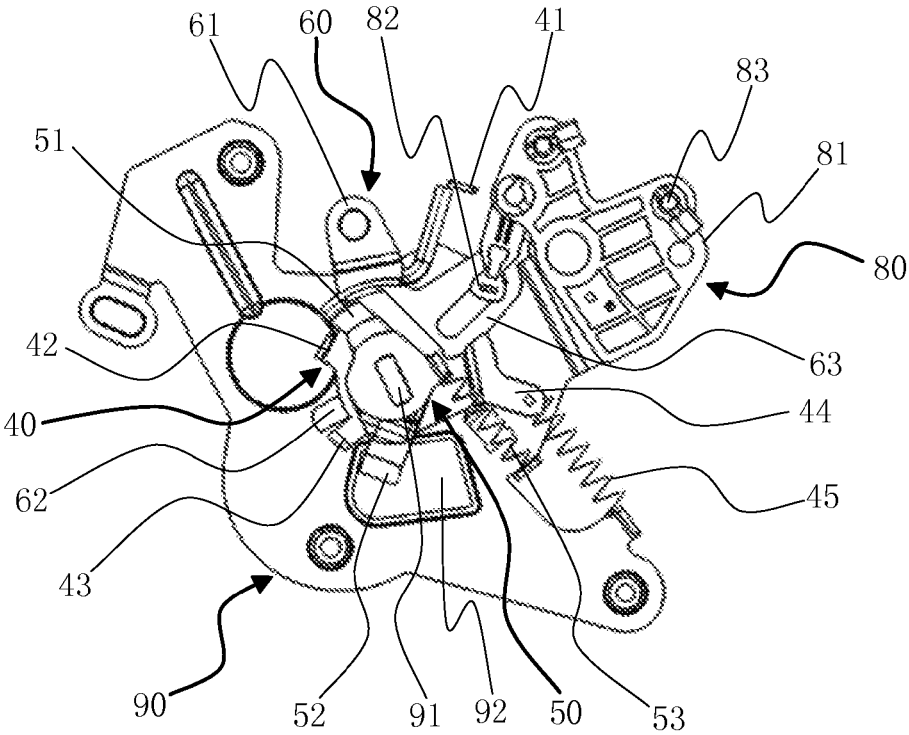
FIG. 8 is a view showing a locking state of the door lock according to the invention.
Figure 9:
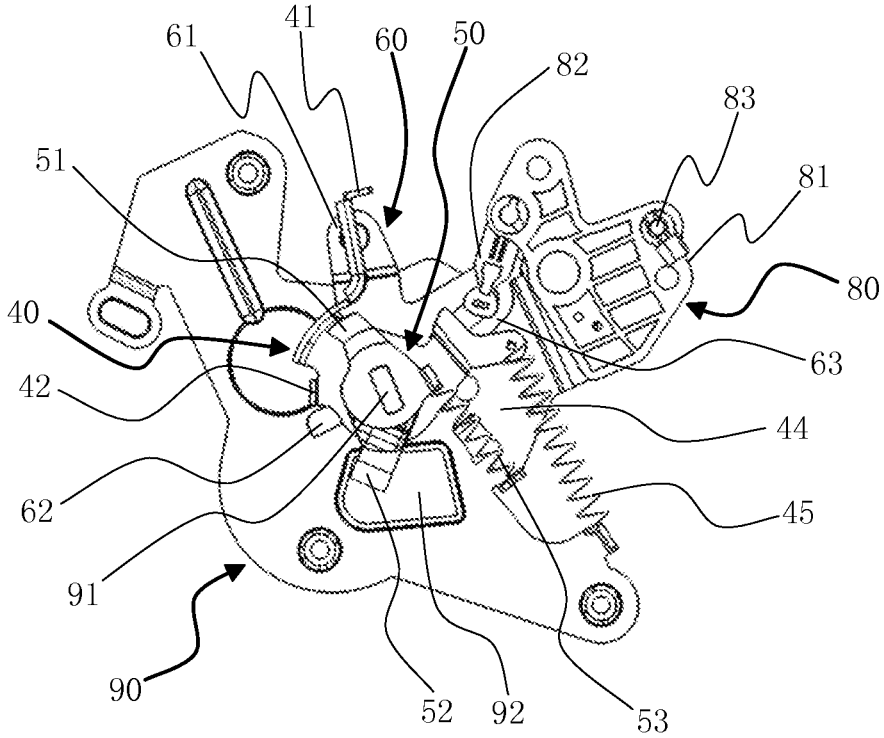
FIG. 9 is a schematic view showing rotation of outer switching element when the door lock of the invention is in the locking state.

As shown in FIG. 8, in the locked state, the sliding block on the end of the crank 82 is on outer side of rotating locus of the outer switching element 40. At this time, the outer handle 10 is operated and the cantilever 11 pulls the cable 20, which in turn drives the first cantilever 41 of the outer switching element 40 in rotation. Meanwhile, the outer switching element 40 rotates around the pin shaft 90, and the fourth cantilever 44 of the outer switching element 40 slides across the third cantilever 63 of the lock body switching element 60 unhinderedly. As shown in FIG. 9, since there is no interference between the outer switching element 40 and the lock body switching element 60 at all during the rotating, the lock body switching element 60 takes no action and the lock body 70 is not opened; once the outer handle 10 is released, the fourth cantilever 44 of the outer switching element 40 will rotate in the opposite direction under the effect of the restoring spring 45 so as to drive the outer switching element 40 in rotation and restore it to original position under the effect of the limiting stop.

When operating the outer handle 10, the inner switching element 50 is rotated. Since the first cantilever 51 of the inner switching element 50 is in abutment fit with the second cantilever 42 of the outer switching element 40, the outer switching element 40 rotates accordingly. Other operational actions have been described above.

Figure 10:
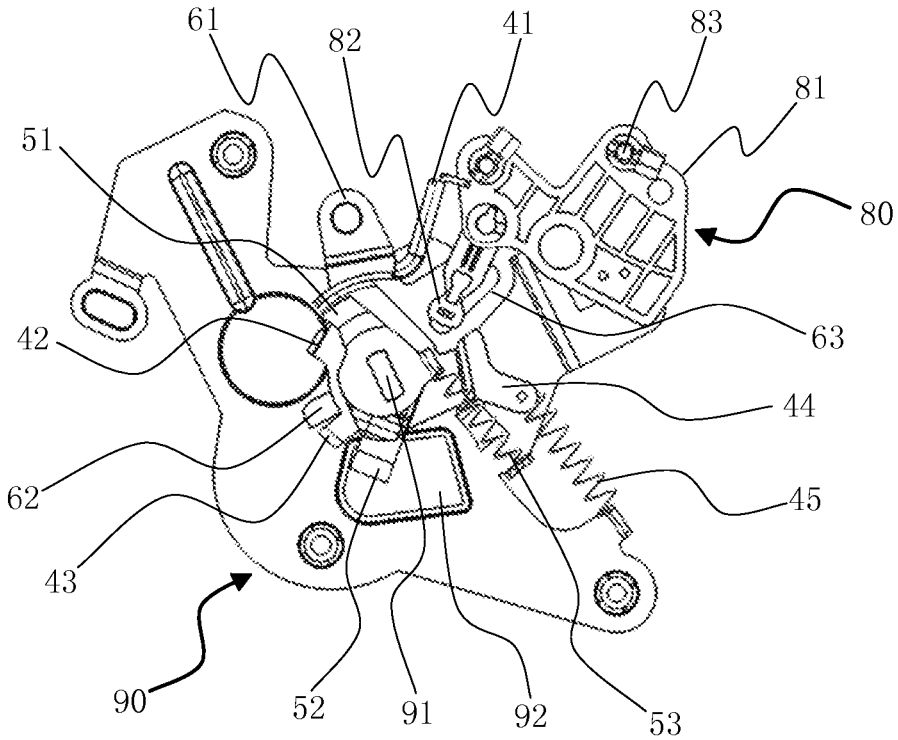
FIG. 10 is a view showing an unlocking state of the door lock according to the invention.
Figure 11:
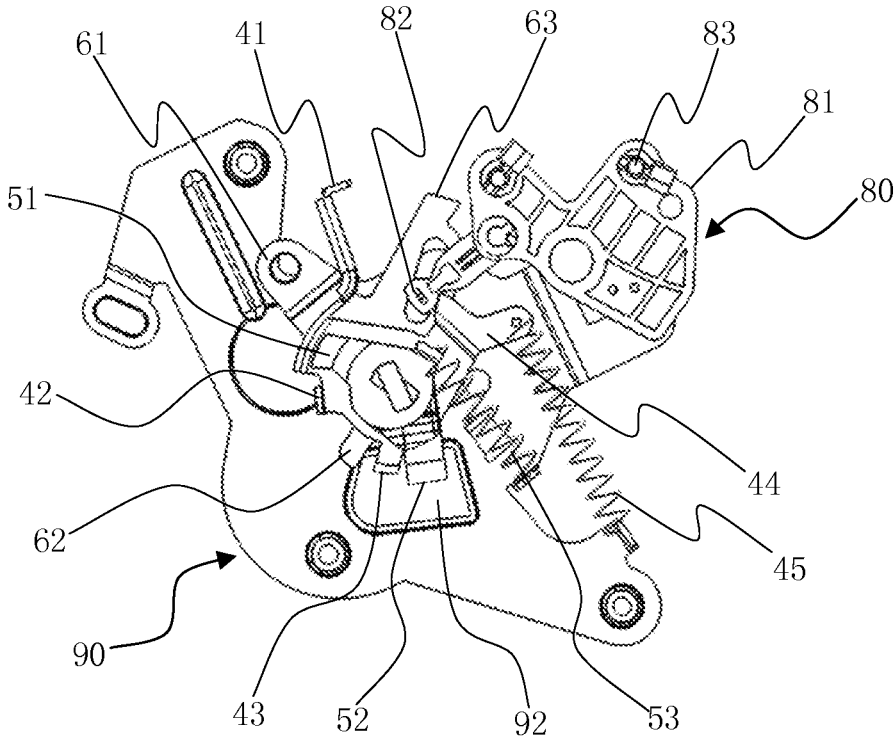
FIG. 11 is a schematic view showing rotation of outer switching element when the door lock of the invention is in the unlocking state.

In an unlocked state, the electrically-actuated or manual deadlock mechanism takes actions, and the lock-up mechanism 80 of the invention is operated by means of the opening hole 83. The rocker arm 81 moves in a stroke limited by the stop 811 and simultaneously drives the crank 82 to operate, so that the sliding block moves to the inner side of the rotating locus of the outer switching element 40 along the sliding groove 64. As shown in FIG. 10, at this time, if the outer handle 10 is operated, the fourth cantilever 44 of the outer switching element 40, after rotating, forms the top-abutment fit with the outer switching element 40. As shown in FIG. 11, under the action of the opening force, the fourth cantilever 44 of the outer switching element 40 continues to rotate and drives the third cantilever of the lock body switching element 60 to rotate by means of the sliding block on the end of the crank 82, so that the first cantilever 61 of the lock body switching element 60 rotates so as to further pull the unlocking lever/string 30 to open the lock body 70; once the outer handle 10 is released, the fourth cantilever 44 of the outer switching element 40 will rotate in an opposite direction under the action of the restoring spring 45, and meanwhile, the third cantilever 43 of the outer switching element 40 drives the second cantilever 62 of the lock body switching element 60 to operate so that the lock body switching element 60 rotates to restore, while the outer switching element 40 also resets to original position under the action of the limiting stop.

When the inner handle is operated after the lock body 70 is unlocked, the inner switching element 50 rotates. Since the first cantilever 51 of the inner switching element 50 is in abutment fit with the second cantilever 42 of the outer switching element 40 mutually, the outer switching element 40 rotates accordingly. Other operational actions have been described above.

What is claimed is:

1. A lock device adapted to a sliding door, wherein the lock device comprises an outer handle fixed on an outside surface of the sliding door, wherein the outer handle is connected to a door lock switching mechanism via a cable, wherein the door lock switching mechanism is provided inside the sliding door, the door lock switching mechanism is connected to a lock body via an unlocking lever/string, and the outer handle opens the lock body through the cable, the door lock switching mechanism and the unlocking lever/string sequentially;

wherein a side of the outer handle that is inside the sliding door is provided with a cantilever extending in the horizontal direction, one end of the cable is fixed on the cantilever, and the other end of the cable is connected to the door lock switching mechanism provided on a bracket, the direction in which the cable is subject to force is perpendicular to the fixed end of the cable on the cantilever, and the bracket is fixed inside the sliding door;

wherein the door lock switching mechanism comprises an outer switching element and a lock body switching element which rotate around a pin shaft independently, the pin shaft is provided on the bracket, one end of the outer switching element is provided with a first cantilever on which a positioning groove is disposed, and the end of the cable connected to the door lock switching mechanism is snap-fit in the positioning groove, one end of a first restoring spring is fixed on the bracket, and the other end of the first restoring spring is connected to the outer switching element to restore it, the lock body switching element is connected to the lock body by means of the unlocking lever/string disposed horizontally, the outer handle opens the lock body through the cable, the outer switching element, the lock body switching element and the unlocking lever/string sequentially;

wherein the door lock switching mechanism further comprises an inner switching element which is disposed coaxially with the outer switching element and the lock body switching element, and the inner switching element is connected to an inner handle, one end of a second restoring spring is fixed on the bracket, and the other end of the second restoring spring is connected to the inner switching element to restore it, the inner handle opens the lock body through the inner switching element, the lock body switching element and the unlocking lever/string sequentially;

wherein the pin shaft passes through the inner switching element, the outer switching element, the lock body switching element and the body of the bracket sequentially, the outer switching element is provided with a second cantilevers, a third cantilever and a fourth cantilever, the lock body switching element is provided with a first cantilever and a second cantilever, an the inner switching element is provided with a first cantilever and a second cantilever; the first cantilever of the inner switching element forms an abutment fit with the second cantilevers of the outer switching element and enables the inner switching element to drive the outer switching element to rotate in the same direction, the second cantilever of the inner switching element forms a limiting fit with a limiting hole (92) in the bracket, the third cantilever of the outer switching element forms an abutment fit with the second cantilever of the lock body switching element and enables the outer switching element to drive the lock body switching element to rotate so as to restore it, a limiting stop is provided on the bracket for restoring the fourth cantilever of the outer switching element to original position after the rotation of the fourth cantilever, the fourth cantilever of the outer switching element is connected to the first restoring spring, the first cantilever of the lock body switching element is hinged to the unlocking lever/string, and the third cantilever forms an abutting fit with the limit stop on the bracket for limiting the stroke of the third cantilever, the limited stroke of the second cantilever of the inner switching element enables the moving stroke of the unlocking lever/string to open the lock body.

2. The lock device adapted to a sliding door according to claim 1, wherein the pin shaft is disposed horizontally and perpendicular to the length direction of a vehicle, and the pulling force direction of the cable is in a tangent line direction to rotation of pin shaft.

3. The lock device adapted to a sliding door according to claim 1, wherein a lock-up mechanism 80 for being the lock body switching element 60 in a locked state or a free state is provided alongside the door lock switching mechanism.

4. The lock device adapted to a sliding door according to claim 3, wherein the lock-up mechanism is composed of a crank and a rocker arm hinged to the bracket, one end of the crank is hinged to the rocker arm, and the other end of the crank is a sliding block provided in a sliding groove, the sliding groove is provided in the third cantilever of the lock body switching element, two end portions of the sliding groove are located on the inner side and outer side of the rotating locus of the outer switching element respectively; when moving to the inner side of the rotating locus of the outer switching element along the sliding groove, the sliding block forms a top-abutment fit with the outer switching element; one end of the rocker arm is provided with a stop which is limited in an opening hole of the bracket, the limited moving stroke of the stop enables the sliding block to slide from one end of the sliding groove to the other end the sliding groove.

5. The lock device adapted to a sliding door according to claim 4, wherein a recess portion is provided between the sliding block and the body of the crank, the fourth cantilever of the outer switching element is in top-abutment with the recess portion, and enables the outer switching element to drive the lock body switching element to rotate so as to open the lock.

6. The lock device adapted to a sliding door according to claim 4, wherein an opening hole which is connected to the lever of an electrically actuated or manual deadlock mechanism is provided in the rocker arm.

* * * * *